US005924925A

United States Patent [19]

Nystrom

[11] Patent Number: 5,924,925

[45] Date of Patent: Jul. 20, 1999

[54] ROOF VENTILATING SYSTEM FOR FRAME CONSTRUCTION BUILDING

[75] Inventor: Bruce C. Nystrom, Spencer, Iowa

[73] Assignee: Metal Works Inc., Spencer, Iowa

[21] Appl. No.: 09/129,273

[22] Filed: Aug. 5, 1998

[51] Int. Cl.[6] ..... F24F 7/04

[52] U.S. Cl. ..... 454/365; 52/199

[58] Field of Search ..... 52/198, 199; 454/364, 454/365

[56] References Cited

U.S. PATENT DOCUMENTS 2,579,662 12/1951 Gibson ..... 454/365
4,073,106 2/1978 Malott ..... 454/365 X

FOREIGN PATENT DOCUMENTS 25 32 515 1/1977 Germany ..... 454/365
60-96845 5/1985 Japan ..... 454/365

OTHER PUBLICATIONS

Ridgolator, one page of brochure/catalog for roof vents and louvered soffits, published prior to Aug. 5, 1998.

*Primary Examiner*—Harold Joyce
*Attorney, Agent, or Firm*—Zarley, McKee, Thomte, Voorhees & Sease

[57] ABSTRACT

A vent for a building includes an elongated vent cover having generally opposite ends. First and second spaced flexible flashing strips can be mounted to the vent cover to form an integrated assembly for mounting on the building so as to extend across a vent opening therein. The ends of the vent cover and the flashing strips having matingly interlocking members thereon for detachably mounting the flexible flashing strips to the vent cover. This can be done without the use of tools. The interlocking members can comprise a pair of lances formed in the end of the vent cover and in corresponding locations on the flashing strips.

19 Claims, 5 Drawing Sheets

ROOF VENTILATING SYSTEM FOR FRAME CONSTRUCTION BUILDING

BACKGROUND OF THE INVENTION

The present invention relates to the field of vents for buildings. More particularly, this invention relates to a convection-type vent for a frame-style building having a peaked roof. The invention is especially well adapted to metal buildings which are often used for storage on farms and the like. The invention provides a vent cover that has an end flashing attachment which snaps into the end cap of the vent cover assembly without the use of tools and then can be installed over the vent opening as an integrated unit.

Vents having powered fans are well-known for ventilating buildings. However, the power required to operate the fan in such devices is not always readily available. Furthermore, ventilating the building in this manner may be cost prohibitive because of the energy costs. Passive, convection-style vents provide a less expensive alternative to powered fans for ventilating buildings. Convection-style vents can be placed in a variety of locations on the building, including but not limited to the sides, ends, or roof. In buildings having peaked roofs, the natural flow of air within the building rises to the uppermost area, which is typically adjacent the peak of the roof. Therefore, it is well known to install one or more individual vents or a single continuous vent along the peak of a roof.

Despite the lack of moving parts and general simplicity of convection-style vents, they are often challenging to install over the vent opening. The vents need to be readily adaptable to roofs of different pitch. The installer must often hold the vent assembly together with one hand while drilling holes for fastening the end flashings to end caps on the vent cover with the other hand. This increases the risk of injury to the installer.

Therefore, there is a need for a vent having an easily mountable end flashing attachment. Thus, a primary objective of the present invention is the provision of a vent that has an end flashing attachment which is easily installable, preferably without the use of tools.

Another objective of the present invention is the provision of a vent having flashing strips and a vent cover which matingly interlock so as to detachably mount the vent cover to the flashing strips and cover the vent opening.

Another objective of the present invention is the provision of a vent wherein a pair of lances in the end of the vent cover and a corresponding pair of lances on the flashing strip engage each other so as to limit the movement of the vent cover relative to the flashing strip in an installed condition.

Another objective of the present invention is the provision of a vent for a roof wherein the vent can be adapted to mount to the peak of a roof having a pitch in a given range.

Another objective of the present invention is the provision of a vent which requires no separate fasteners to secure the vent cover to the flashing strips.

Another objective of the present invention is the provision of a vent which is economical to produce, durable and reliable in use, and relatively easy and safe to install.

These and other objectives will be apparent from the drawings, as well as from the description and the claims which follow.

SUMMARY OF THE INVENTION

The present invention relates to a vent cover assembly in which flashing strips snappingly install to the vent cover without the use of tools. The vent cover assembly can then be mounted over the vent opening on a building as an integrated unit. The vent cover assembly includes first and second spaced flexible flashing strips adapted to mount on the roof adjacent the vent opening and extend across the peak so as to bendingly conform to the peak. These flashing strips and an elongated vent cover having generally opposite ends. The vent cover and the flashing strips having matingly interlocking members thereon for detachably mounting the flexible flashing strips to the vent cover without the use of tools. The interlocking members can comprise a pair of lances formed in the end of the vent cover and in corresponding locations on the flashing strips.

DETAILED DESCRIPTION OF THE PREFERRED EMBODIMENT

Figure 1:
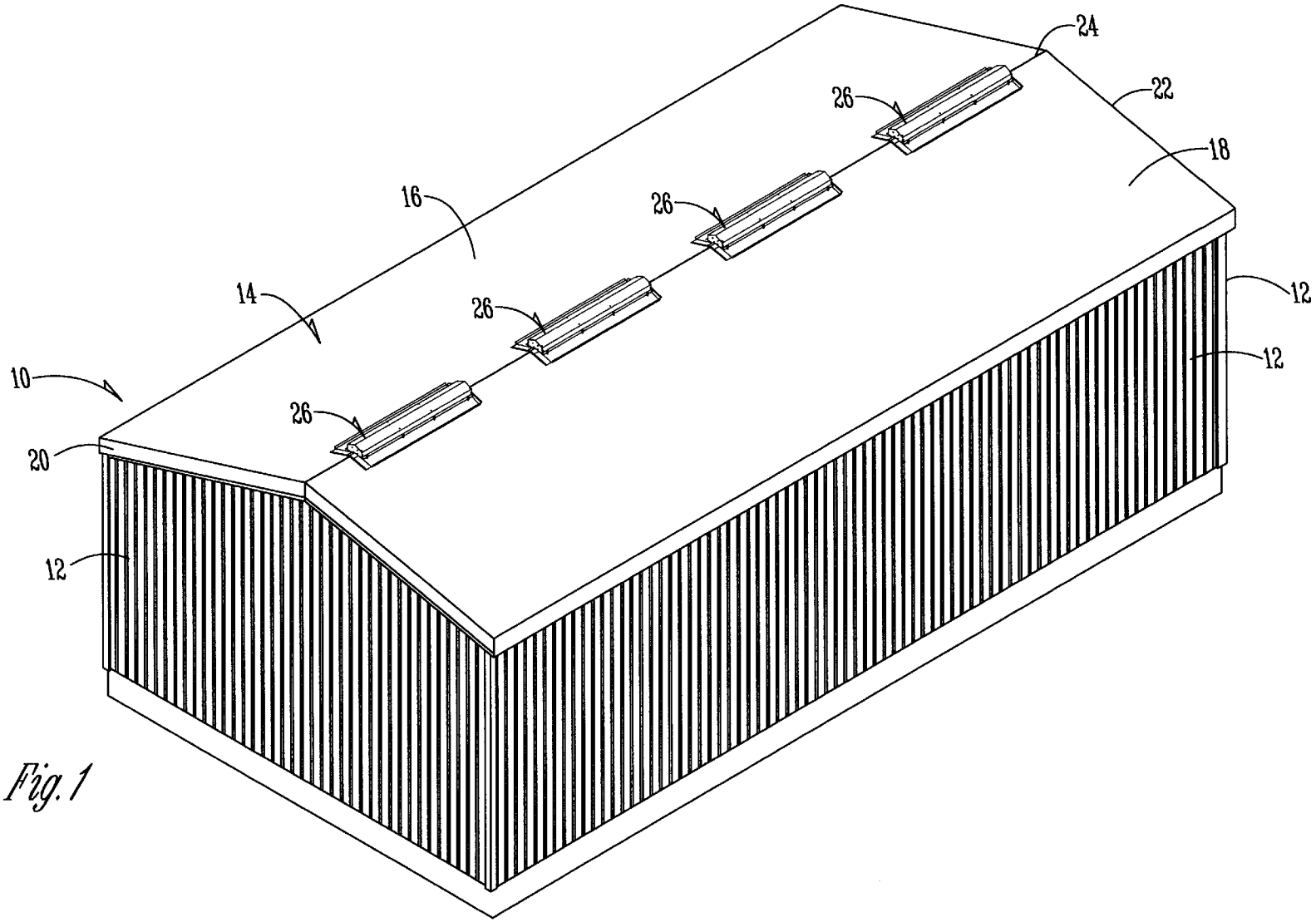
FIG. 1 is a perspective view of the vent of the present invention installed on a building having a peaked roof.

In FIG. 1, a conventional building 10 has a plurality of building sides 12 covered by a roof 14. The roof 14 has a plurality of roof sides 16, 18. The opposite ends of the roof sides 16, 18 form the ends 20, 22 of the roof. The roof sides 16, 18 are peaked with respect to horizontal and meet at a peak 24 or centrally located ridge.

A plurality of convection-type vents 26 are mounted along the peak 24 of the roof 14. The vents 26 can be spaced apart as shown or connected or formed as one continuous vent extending the length of the peak 24. The vents 26 cover a conventional vent opening 25 in the roof 14.

Figure 2:
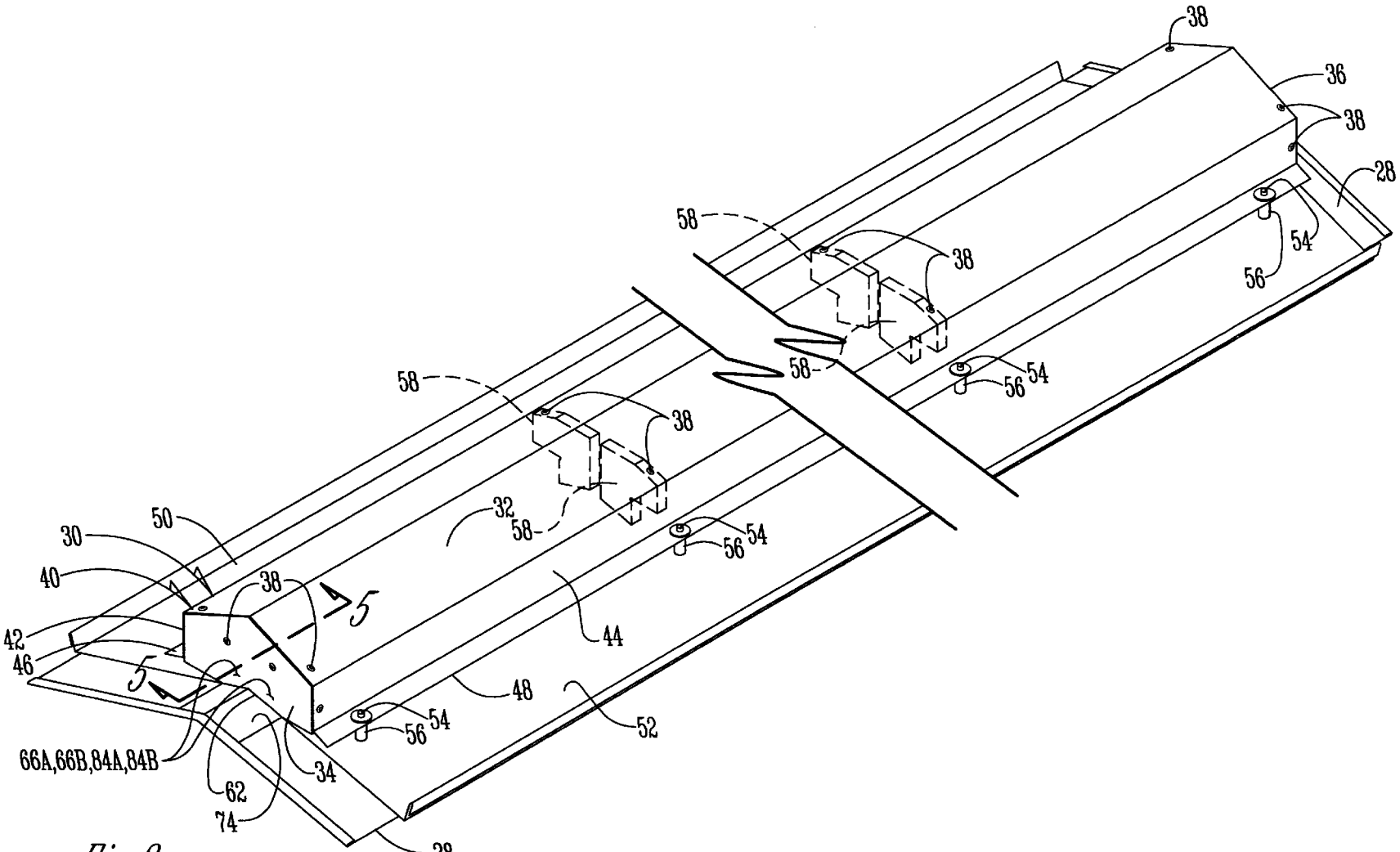
FIG. 2 is a perspective view of the vent of the present invention.

FIG. 2 shows the major components of the vent 26 of this invention. The vent 26 includes a pair of spaced apart flashing strips 28 which snappingly engage an elongated vent cover 30. The vent cover 30 is adapted to extend over the vent opening. The vent cover 30 includes a ventilator cap 32, which is generally elongated. The ventilator cap 32 has end caps 34, 36 which are preferably attached at the factory by conventional fasteners, including but not limited to rivets 38. The ventilator cap 32 also has a raised portion 40 and sides 42, 44 connected thereto.

Figure 5:
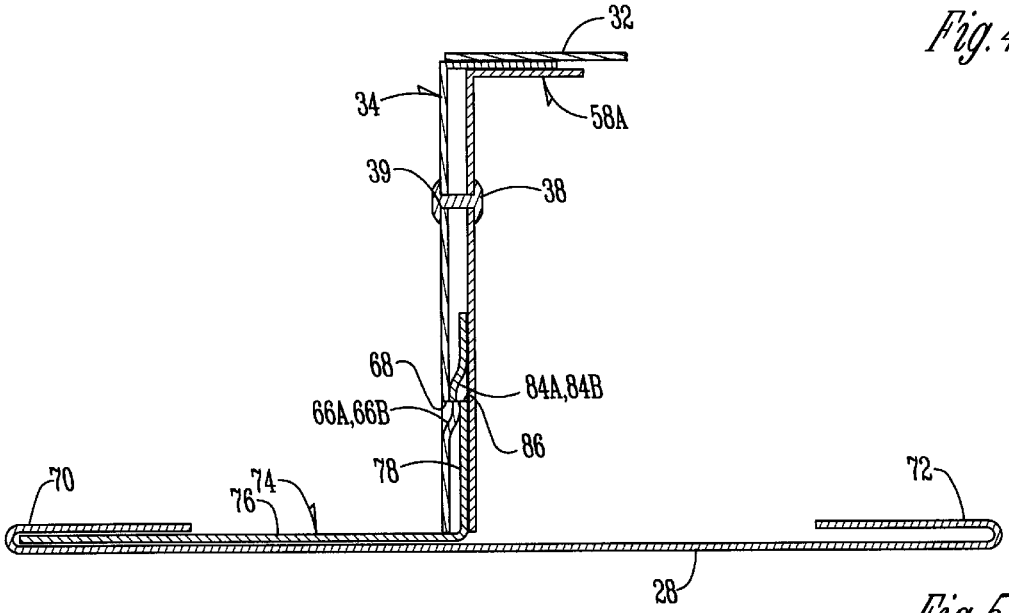
FIG. 5 is a cross-sectional view taken along line 5—5 in FIG. 2 and shows how the riser of the flashing strip engages the end cap of the vent cover.

Each of the sides 42, 44 has a flange 46, 48 extending outwardly therefrom in a substantially horizontal direction. The flanges 46, 48 extend longitudinally along the ventilator cap 32 and provide a means for mounting a pair of skirts 50, 52 in spaced relation to the ventilator cap 32. A plurality of longitudinally spaced fasteners 54 attach the skirts 50, 52 to the respective flanges 46, 48. A preferably hollow tubular spacer 56 is interposed between the flanges 46, 48 and the respective skirts 50, 52 to provide the proper spacing for the ventilation desired. Reinforcing strips 58 and 58A are provided along the length of the ventilator cap 32 and provide additional strength and rigidity, as shown in FIGS. 2 and 5. The assembled vent cover 30 and the detached flashing strips 28 can be sold to the consumer as a complete kit, ready for installation.

Figure 4A:
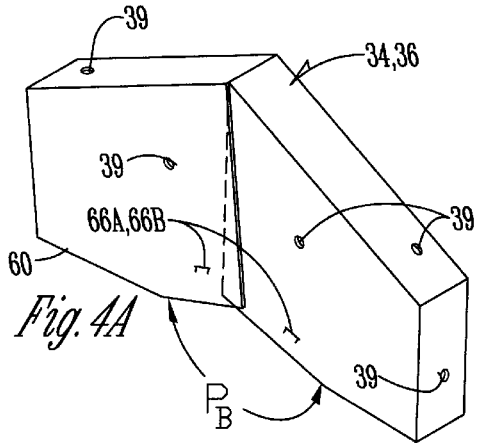
FIG. 4A is similar to FIG. 4, but shows the end cap cut and bent to vary its pitch.
Figure 4:
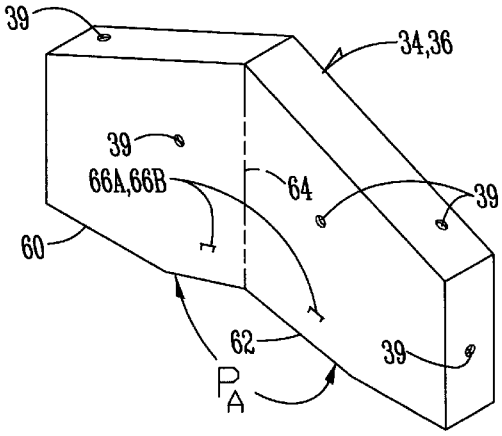
FIG. 4 is a perspective view of the end cap of the present invention.

Referring to FIGS. 2 and 4, the end caps 34, 36 are essentially identical and mount at either end of the ventilator cap 32. As best seen in FIG. 4, a plurality of holes 39 extend through the end cap 34, 36 and receive the fasteners 38. Each of the end caps 34, 36 has a profile in a vertical plane that is adapted to mate with the ventilator cap 32 and substantially match the peak 24 of the roof 14. The lower edge 60 of the end caps 34, 36 includes a centrally located pitch notch 62 which allows the end caps 34, 36 to conform to the peak 24 of the roof 14 within a given range of pitch. Preferably the notch 62 has a pitch or rise over run of between 4/12 and 6/12. FIG. 4 shows that the end caps 34, 36 can have a cut line 64 marked thereon extending from the apex of the pitch notch 62 to the apex of the end cap 34, 36. As shown in FIG. 4A, the end cap 34, 36 can be cut with tin snips along the cut line 64. This allows the end cap to be bent to a smaller angle at its apex. The cut portions of the end cap 34, 36 overlap each other at the cut line 64. The pitch notch 62 which results in FIG. 4A has a greater pitch $P_B$ than the pitch $P_A$ shown in FIG. 4. Another way of looking at this is that the angle at the apex of the notch 62 in FIG. 4 is greater than the angle at the apex of the notch in FIG. 4A.

The end caps 34, 36 include at least one lance, preferably a pair of lances 66A, 66B, which are formed on the outer face of the end cap 34, 36. The lances 66A, 66B are preferably spaced apart laterally on opposite sides of the cut line 64. As best seen in FIG. 5, the lances 66A, 66B on the end cap 34, 36 are punched or formed in the lightweight sheet metal material of the end cap 34, 36. The lances 66A, 66B extend inwardly from the outer face of the end caps 34, 36 along a generally horizontal slit 68.

Figure 3:
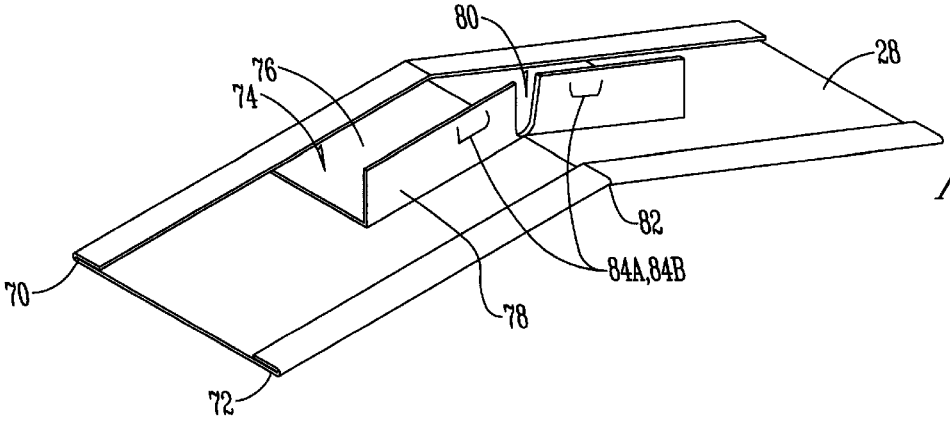
FIG. 3 is a perspective view of the flashing strip of this invention, including the riser.

Referring to FIGS. 3 and 5, the flashing strips 28 are formed of a weather resistant flexible lightweight material, such as sheet metal. The flashing strip 28 preferably includes a folded hem 70, 72 extending longitudinally on either side. The hems 70, 72 add strength and rigidity to the edges of the flashing strip 28 so that conventional fasteners, including but not limited to screws, nails, and the like, may be inserted therethrough to attach the flashing strip 28 (and thereby the vent cover 30) to the roof 14. The folded hem 70 also serves as a means of locating and securing a riser 74 to the flashing strip 28. The riser 74 includes a base 76 having an upright 78 attached thereto. The base rests on the flashing strip 28 and extends under the folded hem 70. Conventional fastening means, such as rivets or spot welds, can also be used to rigidly secure the riser 74 to the flashing strip 28. The upright 78 has a centrally located U-shaped or V-shaped notch 80 therein. The notch 80 extends substantially to the base 76 of the riser 74. The riser 74 is positioned centrally along a longitudinal axis of the flashing strip 28. Due to the notch 80, the flashing strip 28 and the riser 74 attached thereto are capable of bending about a seam or crease 82 so as to juxtaposition or adapt closely to the pitch of the roof 14. Thus, the flashing strip 28 installs flat on the roof sides 16, 18 and extends transversely across the peak 24 of the roof 14.

The flashing strip 28 also includes thereon at least one lance, and preferably a pair of lances 84A, 84B. The lances 84A, 84B are formed or punched in the upright 78 of the riser 74 as shown in FIG. 3, but other locations on the flashing strips 28 are possible without detracting from the invention. The lances 84A, 84B are preferably placed on opposite sides of the notch 80 or the seam 82. As best seen in FIG. 5, the lances 84A, 84B are punched inwardly through the upright 78 toward the base 76 from a substantially horizontal slit 86.

The lances 66A, 66B of the end caps 34, 36 and the lances 84A, 84B of the flashing strips 28 matingly interlock so as to detachably mount the flashing strips 28 to the vent cover 30. The lances 66A, 66B, 84A, 84B slid e over each other vertically until they engage and eventually fully interlock as shown in FIG. 5. In the position shown, the end caps 34, 36 and the vent cover 30 attached thereto cannot be easily moved relative to each other. In fact, the vent cover 30 is secured to the flashing strips 28 and resists movement in both vertical and horizontal directions.

Figure 6:
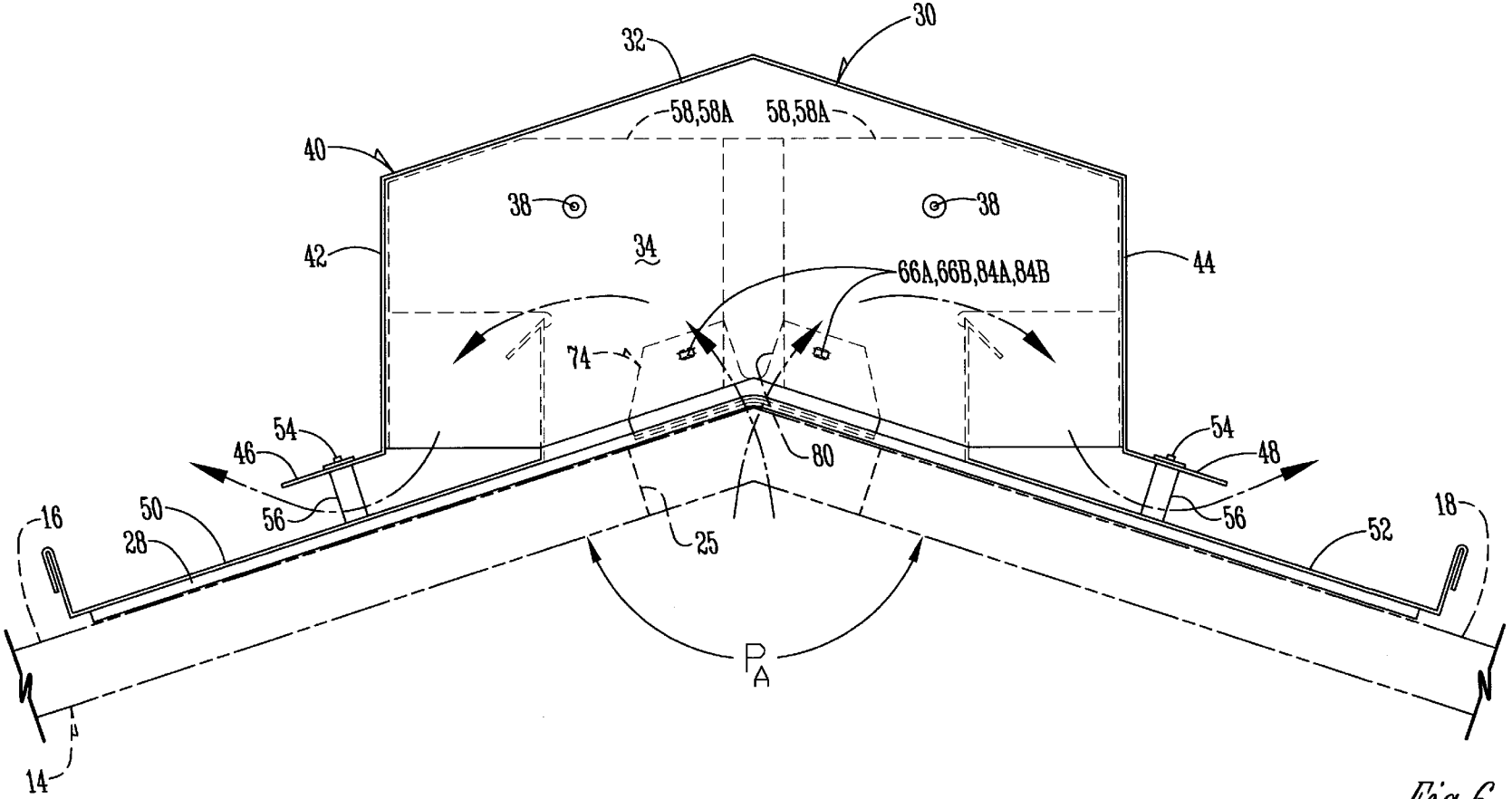
FIG. 6 is an end view of the vent of this invention mounted on a peaked roof having a first given pitch.
Figure 7:
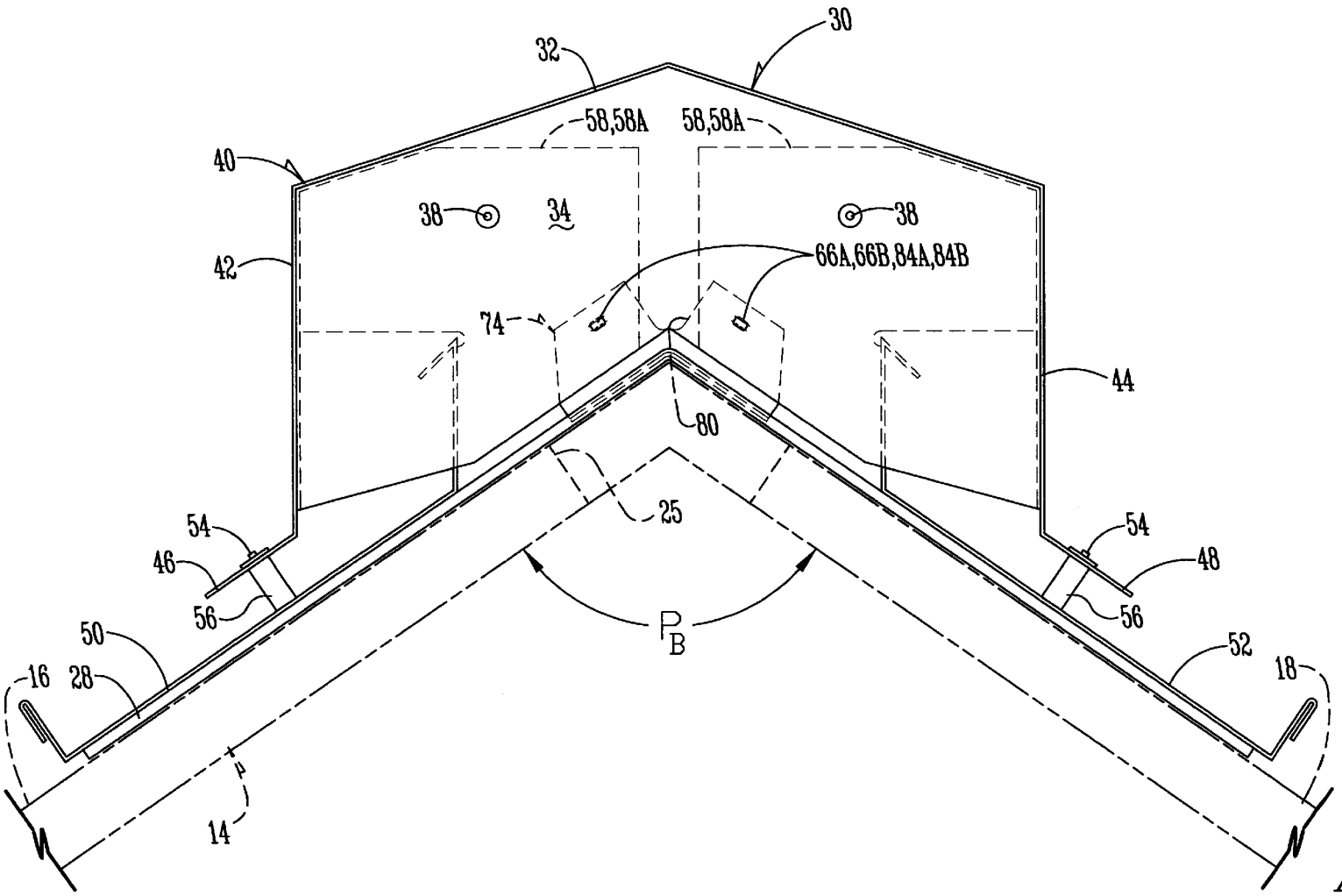
FIG. 7 is an end view similar to FIG. 6, except the cover is mounted on a peaked roof having a second, steeper given pitch.

In use, the integrated vent cover assembly of the present invention is secured across the peak 24 of the roof 14 by the flashing strips 28 and conventional fasteners (not shown) at appropriately spaced intervals along the peak 24. Generally these intervals will correspond to the length of the vent cover 30 selected. This is relatively easy to do because the flashing strips 28 are snappingly preattached to the vent cover 30. Unlike the devices currently available, this preattachment step can be accomplished snappingly without the use of power or hand tools. Conventional vents typically have to be drilled and screwed together just prior to their final placement in the desired location on the roof. The required drilling operation has proven to be slow, cumbersome, and even potentially dangerous when tried on the roof. In this invention the necessary locational relationships are provided at the factory. The vent cover 30 attaches to the flashing strips 28 without drilling, fasteners, or tools. If required, the vent cover 30 can be removed from the flashing strips 28 by using a screw driver to gently pry the lances 66A, 66B, 84A, 84B apart while simultaneously pulling the vent cover 30 away from the flashing strip 28. The device of this invention is extremely flexible. The flashing strips 28 bend to conform to a roof having almost any pitch. The end cap 34, 36 of the vent cover 30 is formed so that it will substantially conform to any roof having a pitch in the range of 4/12 to 6/12. Furthermore, the end cap 34, 36 can be cut as shown in FIG. 4A to conform to pitches from 0/12 to 12/12. FIG. 6 shows the vent 26 of this invention mounted on a roof having a pitch of approximately 4/12. FIG. 7 illustrates how the present invention can be easily adapted to a roof having a pitch of approximately 12/12. The notch 80 can be specifically formed for such a pitch, or the cut line 64 can be utilized and the vent cover 30 bent about the line 64 to provide a steeper pitch.

The vent 26 of the present invention is preferably made of sheet metal or other lightweight, durable and formable material. Of course, the components, including the spacers 56, can be dimensioned so as to provide the desired ventilation space or gap between the ventilator cap 32 and the skirts 50, 52.

Thus, the present invention at least accomplishes its stated objectives.

In the drawings and specification, there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A roof vent for a building having a pitched roof comprising two roof sides joined along an elongated peak having a vent throat opening formed therein, comprising:

first and second spaced flexible flashing strips adapted to mount on the roof and extend across the peak so as to bendingly conform to the peak and the roof sides adjacent the peak; and an elongated vent cover having generally opposite ends, the ends of the vent cover and the flashing strips having matingly interlocking members thereon for detachably mounting the vent cover to the flashing strips so as to cover the vent throat without the use of tools.

2. The roof vent of claim 1 wherein the interlocking members comprise a pair of lances formed on each of the ends of the vent cover and a corresponding pair of lances on each of the flashing strips respectively engageable with the pair of lances on each of the ends of the vent cover so as to limit movement of the vent cover relative to the flashing strip.

3. The roof vent of claim 2 wherein the pair of lances on each of the ends of the vent cover protrude toward the corresponding pair of lances on each of the flashing strips.

4. The roof vent of claim 2 wherein the vent cover and the flashing strips each have a substantially horizontal slit adjacent the lances thereon.

5. The roof vent of claim 2 wherein an end cap is mounted on each end of the vent cover, the lances being formed on the end cap.

6. The roof vent of claim 5 wherein the end cap has a lower edge with a notch formed therein, the notch having a pitch in a given range.

7. The roof vent of claim 6 wherein the pitch of the notch in the end cap is between 4/12 and 6/12.

8. The roof vent of claim 1 wherein the vent cover comprises an elongated vent cap having a raised central portion and opposite sides extending downwardly therefrom, the sides of the vent cap terminating in a laterally protruding flange, a pair of horizontally spaced and elongated skirt members being secured in vertically spaced relation to the flange of the vent cap so as to define a vent gap therebetween adapted to be in fluid communication with the vent opening.

9. The roof vent of claim 8 comprising a plurality of spaced apart spacers, each of the spacers comprising a hollow rod mounted between the flange of the vent cover and the skirt.

10. The roof vent of claim 1 wherein the flashing strips each comprise a substantially flat plate and a riser rigidly attached thereto.

11. The roof vent of claim 10 wherein the riser is generally L-shaped and comprises a base plate and an upright extending therefrom, the base plate being tucked into a folded hem on the flashing strips.

12. The roof vent of claim 10 wherein the flashing strips have at least one edge folded inwardly toward the riser and adapted to slidingly receive the base of the riser.

13. The roof vent of claim 1 wherein one of the flashing strips has a peripheral nailing flange defined by a folded hem along one edge.

14. The roof vent of claim 1 wherein an end cap has preformed holes therein and is secured with rivets to the vent cover through said holes.

15. The roof vent of claim 1 wherein the vent cover includes an end cap having an apex and a lower edge, a substantially vertical slit extending from the apex to the lower edge such that the end cap can be bent in a vertical plane so that the lower edge substantially matches the profile of the roof peak.

16. The roof vent of claim 1 wherein the vent is of a convection type and operates without powered fan blades.

17. A vent for covering a vent opening, comprising:

an elongated vent cover having generally opposite ends;

first and second spaced flexible flashing strips adapted to mount on the ends of the vent cover;

the ends of the vent cover and the flashing strips having matingly snappingly interlocking members thereon for detachably mounting the flashing strips to the vent cover so as to form an integrated unit mountable to cover the vent opening.

18. A method of detachably mounting a roof vent on a roof having an elongated peak and a vent opening therein, the steps comprising:

providing the roof vent with first and second engagement members thereon;

providing first and second flashing members, each of the flashing members being flexible and adapted to extend transversely across the peak, the first and second flashing members each having an engagement member thereon;

attaching the first flashing member to the roof vent by snappingly engaging one of the first and second engagement members with the engagement member on the first flashing member;

attaching the second flashing member to the roof vent by snappingly engaging the other of the first and second engagement members with the engagement member on the second flashing member;

whereby the vent cover and first and second flashing members form an integrated assembly;

mounting the integrated assembly on the roof so as to cover the vent opening by securing both the first and second flashing members to the roof.

19. The method of claim 18 comprising detaching the roof vent from the roof by prying the first and second engagement members away from the engagement members on the first and second flashing members and sliding the vent cover with respect to the flashing members.

* * * * *